US007250911B2

(12) United States Patent
Lindell

(10) Patent No.: US 7,250,911 B2
(45) Date of Patent: Jul. 31, 2007

(54) PLACING OF COMPONENTS ON AN ANTENNA ARRANGEMENT

(75) Inventor: Bo Lindell, Lidingö (SE)

(73) Assignee: Sony Ericsson Mobile Communications AB, Lund (SE)

( * ) Notice: Subject to any disclaimer, the term of this patent is extended or adjusted under 35 U.S.C. 154(b) by 20 days.

(21) Appl. No.: 10/568,395

(22) PCT Filed: Aug. 9, 2004

(86) PCT No.: PCT/EP2004/008891

§ 371 (c)(1),
(2), (4) Date: Feb. 13, 2006

(87) PCT Pub. No.: WO2005/018044

PCT Pub. Date: Feb. 24, 2005

(65) Prior Publication Data

US 2006/0232480 A1 Oct. 19, 2006

Related U.S. Application Data

(60) Provisional application No. 60/497,638, filed on Aug. 25, 2003.

(30) Foreign Application Priority Data

Aug. 18, 2003 (EP) ..... 03077636

(51) Int. Cl.
*H01Q 1/38* (2006.01)

(52) U.S. Cl. ..... 343/702; 343/700 MS

(58) Field of Classification Search ..... 343/702, 343/700 MS, 846
See application file for complete search history.

(56) References Cited

U.S. PATENT DOCUMENTS

| | | | | |
|---|---|---|---|---|
| 6,201,501 | B1 | 3/2001 | Arkko et al. | 343/702 |
| 6,326,927 | B1 | 12/2001 | Johnson et al. | 343/702 |
| 6,593,897 | B1 * | 7/2003 | McConnell | 343/841 |
| 2002/0158803 | A1 | 10/2002 | Hill et al. | 343/702 |
| 2004/0056804 | A1 * | 3/2004 | Kadambi et al. | 343/700 MS |
| 2004/0227678 | A1 * | 11/2004 | Sievenpiper | 343/702 |

FOREIGN PATENT DOCUMENTS

| | | |
|---|---|---|
| EP | 1 317 116 | 6/2003 |
| WO | 02/05380 | 1/2002 |

OTHER PUBLICATIONS

International Preliminary Report on Patentability for PCT/EP2004/008891, Oct. 2004.

* cited by examiner

*Primary Examiner*—Hoang V. Nguyen
(74) *Attorney, Agent, or Firm*—Myers Bigel Sibley & Sajovec, P.A.

(57) ABSTRACT

A portable communication device includes a radio circuit for feeding antenna elements, at least one component which is mildly sensitive to external radio transmission, and an antenna arrangement for sending and receiving radio traffic. The antenna arrangement includes a first antenna element located within and extending through a major portion of the device, and a second smaller antenna element connected to the first antenna element. The radio circuit is connected between the two antenna elements and the component is provided on a section of the antenna arrangement making small contributions to the antenna currents in the antenna arrangement.

15 Claims, 2 Drawing Sheets

PLACING OF COMPONENTS ON AN ANTENNA ARRANGEMENT

RELATED APPLICATIONS

The present application is a 35 U.S.C. §371 national phase application of PCT International Application No. PCT/EP2004/008891, having an international filing date of Aug. 9, 2004 and claiming priority to European Patent Application No. 03077636.3, filed Aug. 18, 2003 and United States Provisional Application No. 60/497,638 filed Aug. 25, 2003, the disclosures of which are incorporated herein by reference in their entireties. The above PCT International Application was published in the English language and has International Publication No. WO 2005/018044.

TECHNICAL FIELD OF THE INVENTION

The present invention relates to the field of antennas and more particularly to a portable communication device with an antenna arrangement provided inside the casing of the device.

DESCRIPTION OF RELATED ART

There is a trend within the field of portable communicating devices, and especially within the field of cellular phones to have the antenna in-built in the phone itself.

One type of such in-built antenna arrangement is described in WO-0237600. Here a cellular phone having an antenna arrangement provided within the casing of the phone is described. The antenna arrangement is made up of a first antenna element in the form of the shielding, casing or chassis of the phone and is fed against a second antenna element functioning as a counterpoise provided at one end of the first antenna element.

There is furthermore a trend towards providing smaller and smaller portable communication devices, especially within the area of cellular phones, why the space in the interior is limited. Therefore the space within the phone has to be used to the maximum. It would then be interesting to provide some components in close proximity of the different antenna elements, especially if these are large. When this is done the antenna arrangement can influence the component in a harmful way if it is not shielded or placed at a suitable distance, which shielding is expensive and can, if the component is another type of antenna, harm the functioning of the component. The component can also influence the antenna characteristics in a harmful way. A distancing of the component from an antenna element leads to a bulky device, which is also often undesirable.

There is therefore a need for providing alternative placement of some types of components in a portable communication device without seriously hampering the functioning of the component and the antenna arrangement and enabling the provision of the component unshielded.

SUMMARY OF THE INVENTION

The present invention is directed towards solving the problem of providing a portable communication device having an in-built antenna arrangement, where some types of components can receive a placing in close proximity of the antenna arrangement without seriously hampering the functioning of the component or the antenna arrangement and enabling the provision of the component without shielding.

The object of the present invention is thus to provide a portable communication device having an in-built antenna arrangement, where some types of components can receive a placing in close proximity of the antenna arrangement without seriously hampering the functioning of the component and the antenna arrangement and enabling the provision of the component without shielding.

According to a first aspect of the present invention, this object is achieved by a portable communication device comprising:

- a radio circuit for feeding antenna elements,
- at least one component which is mildly sensitive to external radio transmission, and
- an antenna arrangement for sending and receiving radio traffic comprising
  - a first antenna element located within and extending through a major portion of the device, and
  - a second smaller antenna element connected to the first antenna element,
- wherein the radio circuit is connected between the two antenna elements and said component is provided on a section of the antenna arrangement making small contributions to the antenna currents in the antenna arrangement.

A second aspect of the present invention is directed towards a portable communication device including the features of the first aspect, wherein the first antenna element extends along most of the width of the device.

A third aspect of the present invention is directed towards a portable communication device including the features of the first aspect, wherein the first antenna element has a flat shape, preferably provided in a layer of the main circuit board of the device.

A fourth aspect of the present invention is directed towards a portable communication device including the features of the first aspect, wherein the second antenna element is in the form of an elongated body stretching essentially along a side of the first antenna element.

A fifth aspect of the present invention is directed towards a portable communication device including the features of the fourth aspect, wherein the first antenna element is joined with the second antenna element at a first end of said side, thereby providing a gap between the first and second antenna elements, the length of which is essentially defined by the length of the side of the first antenna element and the length of the second antenna element.

A sixth aspect of the present invention is directed towards a portable communication device including the features of the fifth aspect, wherein the radio circuit is connected between the first and second antenna element between the first and a second end at said side.

A seventh aspect of the present invention is directed towards a portable communication device including the features of the first aspect, wherein the component is unscreened.

An eighth aspect of the present invention is directed towards a portable communication device including the features of the first aspect, wherein the component is a further antenna for a separate type of communication, preferably a positioning antenna for receiving position information, for instance via satellite.

A ninth aspect of the present invention is directed towards a portable communication device including the features of the eighth aspect, wherein the component is placed orthogonally to the first antenna element so that the antenna currents of the component are orthogonal to the antenna currents on at least the first antenna element.

A tenth aspect of the present invention is directed towards a portable communication device including the features of the ninth aspect, wherein the component is placed at an end of the first antenna element furthest from the second antenna element.

An eleventh aspect of the present invention is directed towards a portable communication device including the features of the ninth aspect, wherein the component is placed on the second antenna element.

A twelfth aspect of the present invention includes the features of the eleventh aspect, wherein the component is placed on a part of the second antenna element that is perpendicular to the first antenna element.

A thirteenth aspect of the present invention includes the features of the eleventh aspect, wherein the second antenna element serves as ground plane for the component.

A fourteenth aspect of the present invention includes the features of the first aspect, wherein the component is placed on the second antenna element.

A fifteenth aspect of the present invention includes the features of the fourteenth aspect, wherein the first antenna element is provided in a layer of the main circuit board of the device and the leads to the component are provided in another layer and provided to the component via the connection between the first and second antenna elements.

A sixteenth aspect of the present invention includes the features of the first aspect, wherein the radio circuit includes at least one tuning network for tuning the antenna to one or more frequency bands.

A seventeenth aspect of the present invention includes the features of the first aspect, in which the device is a cellular phone.

The invention has the following advantages. The antenna arrangement provides good wideband properties while still allowing the device to be small in size. It allows placing of components that are mildly sensitive to radiation without shielding close to antenna elements in the device, which lowers the complexity of the construction and also the cost of the device. This placing also enables the manufacturing of a slimmer device. The device according to the ninth aspect furthermore reduces the coupling between the component, if this is another type of antenna, and the antenna arrangement, which is advantageous if the component is to receive weak signals for example from a satellite. In the device according to the thirteenth aspect there is no need to provide an extra ground plane for the component, since the second antenna element provides this.

It should be emphasized that the term "comprises/comprising" when used in this specification is taken to specify the presence of stated features, integers, steps or components, but does not preclude the presence or addition of one or more other features, integers, steps, components or groups thereof.

BRIEF DESCRIPTION OF THE DRAWINGS

The present invention will now be described in more detail in relation to the enclosed drawings, in which.

DETAILED DESCRIPTION OF EMBODIMENTS

A portable communication device according to the invention will now be described in relation to a cellular phone, which is a preferred variation of the invention. The portable communication device can be another type of device though, like a cordless phone, a communication module, a PDA or any other type of portable device communicating with radio waves.

Figure 1:
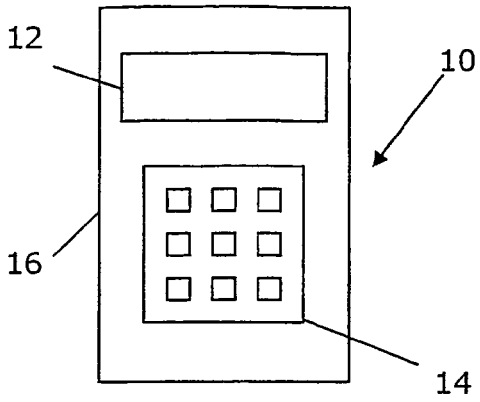
FIG. 1 schematically shows a front view of a cellular phone according to the invention, FIG. 2 schematically shows the relevant parts of the invention in a front view inside the casing of a phone according to a first embodiment of the invention, FIG. 3 schematically shows the relevant parts of the invention in a front view inside the casing of a phone according to a second embodiment of the invention.

FIG. 1 schematically shows a front view of a cellular phone 10 according to the invention. The phone 10 includes a display 12 and a keypad 14 provided on a casing 16 of the phone. Here it is worth noting that there is no antenna protruding from the phone. The antenna is in-built.

Figure 2:
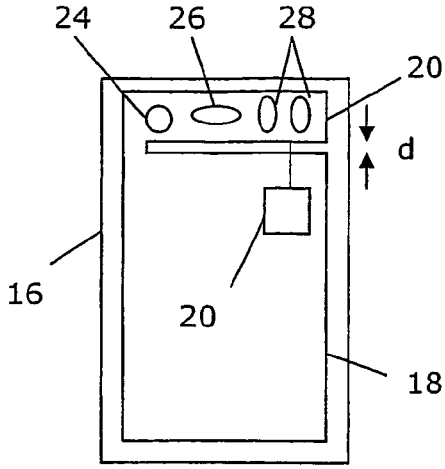

FIG. 2 schematically shows a top view of an antenna arrangement provided for communication in at least one radio frequency band, for instance the GSM band, which arrangement is provided in the interior of the casing 16 of the phone. The antenna arrangement includes a first antenna element 18, which is formed like a plate and stretches inside most of the length of the phone and essentially along the whole width of the phone. This element 18 is preferably provided as a layer in the main circuit board of the phone. The arrangement also includes first a second, also plate shaped, antenna element 20 provided at a top side of the phone casing 16. The second antenna element 20 has an elongated shape stretching along the top side of the phone casing 16 as well as along the top side of the first antenna element 18, so that the second antenna element 20 essentially has the same length as the first antenna element 18 is wide. The two antenna elements are joined together at a first end of said top side of the casing 16 and of the top side of the first antenna element 18 but otherwise spaced apart such that a gap d is defined between them. Thus at a second end of the top side of the casing, the antenna elements are not joined to each other, such that the gap stretches inwards up to the point where the first and second antenna elements are joined close to the first end. It is important to point out that with a gap is meant a space where no conducting elements are placed. Different isolators or plastic material can however be placed here.

How these two antenna elements can be provided together is described in more detail in EP-application 02026232.5, which is herein incorporated by reference. This document describes an antenna for a clamshell phone, where the second antenna element is provided in the hinge. The teachings of this document can however easily be applied on a second antenna element provided in the main portion or casing of a phone. A radio circuit 22 is provided on the first antenna element 18, but screened from it and is connected between the first and the second antenna element 18 and 20 and feeding the second antenna element 20 over the gap via a screened conductor as well as feeding the first antenna element 18. The first antenna element is here end-fed, which means that the connection point between the radio circuit 22 and the first antenna element 18 is provided at the top side of the first antenna element 18. The feeding of the first and second antenna elements 18 and 20 is preferably provided close to the second end of the casing. The feeding points can however be varied in line with the teachings of EP 02026232.5.

The second antenna element 20 is thus provided near the feed end of the first antenna element 18. As is shown, the radio circuit 22 is provided on the main circuit board, i.e. on the first antenna element 18. The radio circuit 22 feeds the main circuit board as antenna using the second antenna element 24 as counterpoise within a certain frequency band of a number of bands used by the phone. For this reason the radio circuit includes tuning filters. How this feeding can be done is disclosed in more detail in WO-0237600, which is herein incorporated by reference. The circuit board can have a length approaching a half wavelength at the operating frequency band (e.g. around 900 MHz for a cellular phone working in one frequency band of the GSM specification). It can also be equal to the full wavelength. It does not have to have these lengths in order to function, though. A number of components that are mildly sensitive to radio transmission caused by the antenna arrangement are provided on the second antenna element 20. These components include a speaker 24, a vibrator 20 and two LEDs (Light emitting diodes) 28.

Figure 3:
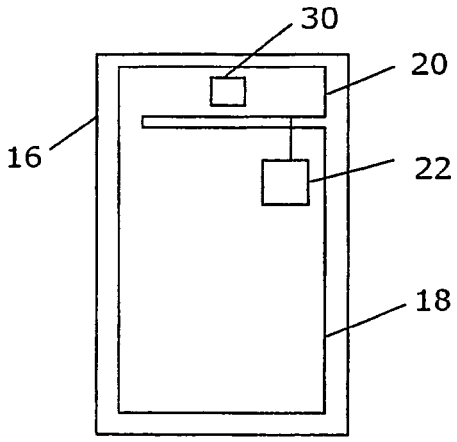

FIG. 3 shows a similar construction to FIG. 2, but here there is only one component in the form of a positioning antenna 30 of the GPS (Global Positioning System) type.

Figure 4:
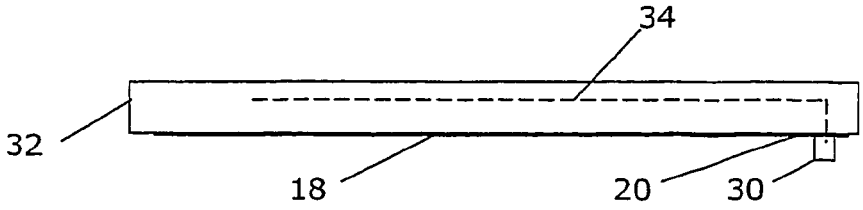
FIG. 4 shows a side view of the antenna arrangement provided on a main circuit board as well as a component provided on the main circuit board, FIG. 5 schematically shows a perspective view of an antenna arrangement in a device according to a third embodiment of the invention, and FIG. 6 schematically shows a perspective view of an antenna arrangement in a device according to a fourth embodiment of the invention.

FIG. 4 shows a side view of the main circuit board 32 of the phone having the antenna arrangement and component 30 according to FIG. 3. It should be realised that this view is equally as well applicable for the phone according to FIG. 2. The antenna arrangement is, as was mentioned before, preferably provided as a plane in the main circuit board and then preferably the ground plane, thus including both the first 18 and the second antenna element 20. This plane does however have to include the gap between the two elements (not shown). The electrical leads 34 necessary for driving the GPS antenna 30 are here provided in the interior of the main circuit board and can therefore easily be shielded.

These leads are however not crossing the gap, but are in this joining region provided in the area of the section joining the first and second antenna elements in order to reduce the influence on the antenna arrangement. The second antenna element can here also serve as a ground plane for the GPS antenna, which is preferably a ceramic chip antenna.

The current distribution on the antenna arrangement in these embodiments is concentrated to the middle of arrangement, i.e. to the middle of the first antenna element as seen in the view of FIG. 4, i.e. in the length dimension of the first antenna element and is lower at the second antenna element and the bottom side opposite the top side of the first antenna element. Consequently the only mildly sensitive components placed on the second antenna element need not be shielded to function satisfactorily, which makes the phone simpler and cheaper to produce and since these components can be placed there, space is freed from other parts of the phone, which can be used for the placing of other components. This freed space is provided on the rest of the main circuit board and should therefore be shielded.

The reception of GPS signals from a satellite can be hampered by the radio transmission from the first antenna element. This hampering was in the embodiment according to FIG. 3 solved by placing the GPS antenna on the second antenna element. This is in many cases sufficient.

Figure 5:
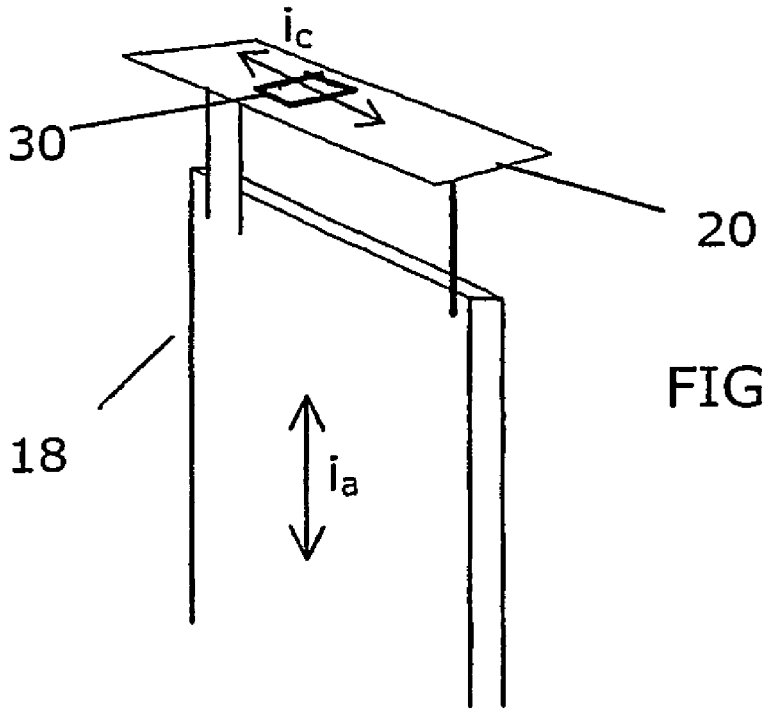

In order to even further reduce the influence from the first antenna element a device according to a third embodiment of the invention is provided, which is shown in FIG. 5. FIG. 5 shows a perspective view of the first and second antenna elements according to this embodiment. Here the second antenna element 20 is provided in the form of a flat plate placed at right angles to the top end of the first antenna element 18 and the GPS antenna 30 is placed on top of the upper surface of the second antenna element 20 that faces away from the first antenna element 18. It should be noted that the second antenna element 20 is here not a part of the main circuit board. As mentioned before the majority of the antenna currents $i_a$ from the antenna arrangement are provided in the plane of the first antenna element, and then in the middle in the length dimension of the first antenna element 18. This leads to the antenna pattern of the antenna arrangement being essentially provided in a direction perpendicular to the plane of the first antenna element. The antenna currents $i_c$ in the GPS antenna 30 are on the other hand provided in the orthogonal plane provided by the second antenna element 20. This leads to the antenna pattern for the GPS antenna 30 being essentially provided perpendicular to the main antenna pattern of the antenna arrangement. In this way the influence of the antenna arrangement on the GPS antenna is reduced considerably, such that GPS position signals can be more easily received without disturbances. The coupling between the two antenna systems is thus reduced considerably.

Figure 6:
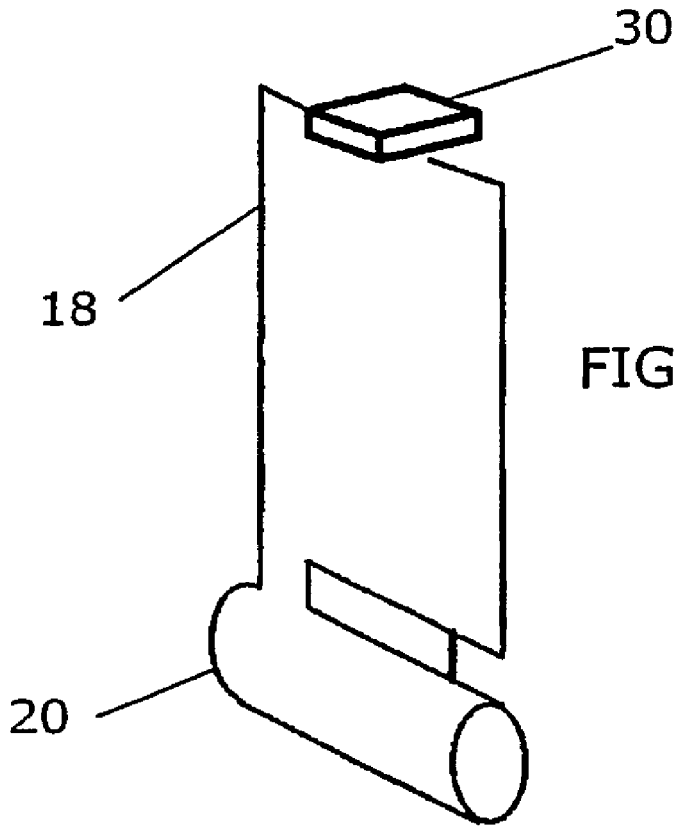

An alternative placing of the GPS antenna is shown in FIG. 6, which shows a perspective view of the antenna arrangement and GPS antenna 30 in a portable communication device according to a fourth embodiment of the present invention. Here the second antenna element 20 is provided at the bottom side of the first antenna element 18. The second antenna element 20 is furthermore provided as a hollow cylindrical body, where the interior of the cylinder may be shielded in order to include electrical components such as perhaps a battery. The GPS antenna 30 is here provided at the top side of the first antenna element but at an angle perpendicular to the plane of the first antenna element. This solution guarantees essentially the same advantages as in the third embodiment of the invention.

The present invention has many advantages. The antenna arrangement provides good wideband properties while still allowing the device to be small in size. It allows placing of components that are mildly sensitive to radiation without shielding close to antenna elements in the device, which lowers the complexity of the construction and also the cost of the device. This also enables the manufacturing of a slimmer device, which is often of advantage from a marketing perspective. The device according to the third and fourth embodiments furthermore reduces the coupling between the component, if this is another type of antenna, and the antenna arrangement. This is of great advantage if the component is to receive weak signals, for example from a satellite. In the second and third embodiments there is no need to provide an extra ground plane for the component, since the second antenna element provides this, which reduces the cost and complexity of the device even further.

The present invention can be varied in many ways. It is possible to vary the second antenna element of the first, second and third embodiments according to the principles shown in the fourth embodiment, i.e. to provide a hollow possibly shielded body. The position of the second antenna element can of course also be at the bottom end for these embodiments. It should be realised that this body does not have to be cylindrical, but can just as well have for instance a rectangular cross-section. The interior can then also include additional or perhaps other components like a camera. The embodiment according to FIG. 6 can also be modified in that the second antenna element is provided in the same plane as the first antenna element and can then also be provided as a part of the ground plane of the main circuit board. The second antenna element was in some of the described embodiments provided in the same plane as the first antenna element. It is also possible to place it slightly above the first antenna element in order to further reduce the size in the length direction of the phone. In this case the component can be placed on a surface of the second antenna element facing the main circuit board. In this case it is also not possible to provide the second antenna element as a part of the ground layer in the main circuit board. The types of components used can furthermore be varied. Examples of other types of components are electromechanical switches and headphone jacks. The positioning antenna described need not be a GPS type of antenna but can be any other type of positioning antenna. It need furthermore not be a positioning antenna at all. It can be any antenna arranged to operate separately from the main communication antenna arrangement.

The invention claimed is:

1. A portable communication device comprising:

an antenna arrangement for sending and receiving radio traffic, the antenna arrangement comprising:

a first flat antenna element located within and extending through a major portion of the device, and a second antenna element comprising an elongated body extending essentially along a side of the first antenna element and being connected to the first antenna element at a first end of the side of the first antenna element thereby providing a gap between the first and second antenna elements, the gap having a length generally defined by the length of the side of the first antenna element and the length of the second antenna element, a radio circuit for feeding antenna elements connected between the first and second antenna element between the first and a second end of the side of the first antenna element, and at least one additional antenna configured for a type of communication provided on a section of the antenna arrangement making contributions to the antenna currents in the antenna arrangement.

2. A portable communication device according to claim 1, wherein the first antenna element extends along a substantial portion of a width of the device.

3. A portable communication device according to claim 1, wherein the device includes a main circuit board, and the first antenna element has a flat shape provided in a layer of the main circuit board of the device.

4. A portable communication device according to claim 1, wherein the additional antenna is placed orthogonally to the first antenna element so that the antenna currents of the additional antenna are orthogonal to the antenna currents on at least the first antenna element.

5. A portable communication device according to claim 4, wherein the additional antenna is placed on the first antenna element at an end thereof distal from the second antenna element.

6. A portable communication device according to claim 4, wherein the additional antenna is placed on the second antenna element.

7. A portable communication device according to claim 6, wherein the additional antenna is placed on a part of the second antenna element that is perpendicular to the first antenna element.

8. A portable communication device according to claim 6, wherein the second antenna element serves as a ground plane for the component.

9. A portable communication device according to claim 1, wherein the additional antenna is placed on the second antenna element.

10. A portable communication device according to claim 9, wherein the device further comprises a main circuit board and leads to the component and the first antenna element is provided in a layer of the main circuit board of the device and the leads to the component are provided in another layer and provided to the component via the connection between the first and second antenna elements.

11. A portable communication device according to claim 1, wherein the radio circuit includes at least one tuning network for tuning the antenna to one or more frequency bands.

12. A portable communication device according to claim 1, wherein the device is a cellular phone.

13. A portable communication device according to claim 1, wherein the additional antenna comprises a positioning antenna for receiving position information.

14. A portable communication device according to claim 13, wherein the positioning antenna receives the position information via satellite.

15. A portable communication device according to claim 1, wherein the first flat antenna element and the second small antenna element are configured for a first type of communication and the additional antenna is configured for a second type of communication that is different than the first type of communication.

* * * * *